US005996906A

United States Patent [19]

Cooper

[11] Patent Number: 5,996,906

[45] Date of Patent: Dec. 7, 1999

[54] HOSE NOZZLE COVER

[76] Inventor: J. Carl Cooper, 15288 Via Pinto, Monte Sereno, Calif. 95030

[21] Appl. No.: 09/002,751

[22] Filed: Jan. 5, 1998

Related U.S. Application Data

[60] Provisional application No. 60/034,009, Jan. 6, 1997.

[51] Int. Cl.[6] ..... B05B 3/00

[52] U.S. Cl. ..... 239/229; 239/251; 239/288; 239/499; 239/519; 15/1.7

[58] Field of Search ..... 239/229, 288, 239/288.3, 288.5, 462, 499, 519, 589, 251; 15/1.7

[56] References Cited

U.S. PATENT DOCUMENTS

| | | | |
|---|---|---|---|
| 180,790 | 8/1876 | Van Dussen Reed | 239/589 |
| 2,420,958 | 5/1947 | Landreth | 239/542 |
| 2,515,600 | 7/1950 | Hayes | 239/542 |
| 3,074,078 | 1/1963 | Varian | 239/542 |
| 3,429,125 | 2/1969 | Shotton | 239/542 |
| 3,776,464 | 12/1973 | Profitt | 239/229 |
| 3,872,533 | 3/1975 | Profitt | 15/1.7 |
| 4,589,986 | 5/1986 | Greskovics | 15/1.7 |

*Primary Examiner*—Andres Kashnikow
*Assistant Examiner*—Dinh Q. Nguyen
*Attorney, Agent, or Firm*—J. Carl Cooper

[57] ABSTRACT

The present invention is an apparatus and method to reduce unwanted spraying of fluids from hose nozzles. In the preferred embodiment of the invention, a hole filled cover is attached over an open end of the nozzle of the hose. When the hose is in a position where unwanted spray is unlikely to take place the spray stream passes through the cover unaltered. If the nozzle moves to a position where unwanted spray is likely to take place, the cover deflects over the liquid stream causing it to be disbursed or scattered rather than sprayed over a long distance. The invention finds particular application in the prevention of spraying of water from the high pressure cleaning nozzle in swimming pool cleaners onto nearby objects or persons.

15 Claims, 4 Drawing Sheets

HOSE NOZZLE COVER

This application claims the benefit of U.S. Provisional Application No. 60/034,009 filed Jan. 6. 1997.

BACKGROUND OF THE INVENTION

The invention relates to a cover to prevent undesired spraying of fluids from movable nozzles, pipes, tubes, hoses and the like. The invention is of particular use in conjunction with swimming pool cleaning machines. The pressure necessary to produce a stream of fluid for use in pressure cleaning, coating, or other applications of the fluid can cause the exit orifice or nozzle to move due to the pressure differential created by the exiting of the fluid. Such action is what commonly propels jet and rocket engines. When inadequately restrained, the nozzles tend to whip about due to this jet action, causing the fluid to be sprayed uncontrollably. Often such spray pressure is desired but the movement is not, allowing the nozzle to simply be mechanically fixed to a support to prevent such movement.

In other instances the whipping motion, or the ability to easily move the nozzle is desirable, preventing fixing the nozzle to a support. The present invention finds particular use in applications to prevent water from the pressure cleaning nozzle in swimming pool cleaners from being sprayed out of the swimming pool. Such spraying out of the pool is quite undesirable since the water is full of chemicals which leave water spots on windows, vehicles, furniture, etc. as well as being quite annoying to people in the vicinity of the pool who are unexpectedly sprayed with the cold high pressure stream of water.

Other applications of the invention include those where a spray stream is desired to be restrained to certain directions or areas, or where uncontrolled spraying is to be diminished. Such application for example would include a fire hose where it is desired to prevent the hose from whipping about uncontrollable in the event the holder loses grip on the hose.

1. Field of the Invention

This invention relates to the field of reducing the undesirable spray of pressurized fluid streams such as liquid, gas, slurry or others, from a nozzle. Typical applications include those where a nozzle can be caused by fluid pressure to whip about if left unsecured, or whenever the nozzle is deflected from a known range of positions.

2. Description of the Prior Art

In the Prior art it is known that to provide various weighting and holding devices to prevent the nozzle from flailing about from the propulsion caused by discharge of pressurized fluid. Such uncontrolled spraying can be mitigated by securing the nozzle to direct the spray in a harmless direction. In some applications, for example such as swimming pool cleaners, it is desired to have the nozzle, and even the hose to which it is attached, flail about so that clamping and weighting are undesirable. What is needed is a device which will allow the propulsion action to cause the nozzle (and hose) to whip about within known parameters, while preventing the fluid stream to uncontrollably shoot about.

OBJECTS OF THE INVENTION

An object of the invention is to reduce the spray of a fluid stream exiting from a movable orifice.

Another object of the invention is to restrict the movement of an orifice from which a spray of a fluid stream exits.

Still another object of the invention is to allow the spray of a fluid stream exiting from a movable orifice without interference when the orifice is in a first range of positions and alter the spray when the orifice is in a second range of positions.

Yet another object of the invention is to provide a cover having a perforated surface which is affixed to a spray nozzle such that the spray hits the perforated surface causing the spray to be dissipated without adversely diminishing the propulsion which moves the nozzle.

A further object of the invention is to provide an apparatus including an attachment portion for attaching the apparatus relative to the nozzle and to further provide a dissipation portion which moves with respect to the nozzle such that when the nozzle deviates from a known range of positions the spray is directed at the dissipation portion thereby causing the spray to be dissipated.

A still further object of the invention is to reduce unwanted spray of a fluid from a nozzle which moves over a fixed surface, including attaching a tubular member which is full of holes directly or indirectly to the nozzle in a fashion such that its movement is permitted for a first range of motion of the nozzle and restricted for a second range of motion of the nozzle such that when the nozzle deviates from a known range of positions with respect to the fixed surface the spray is directed at the tubular member thereby causing the spray to be dissipated.

A yet further object of the invention is to provide an apparatus covering at least part of said nozzle, in which one end facilitates directly or indirectly affixing the apparatus to the nozzle, which a dissipation portion including a perforated middle part of the apparatus, wherein the dissipation portion moves with respect to the nozzle such that when said nozzle deviates by a known amount from a known position the perforated middle part of the dissipation portion is deflected into the spray and the spray is dissipated.

Yet still another object of the invention is to provide a dissipation portion made up of an open perforated material.

A yet still further object of the invention is to provide a dissipation portion made up of a woven material.

An additional object of the invention is to provide a dissipation portion made up of a knitted material.

A still additional object of the invention is to provide a dissipation portion made up of a knitted metallic wire.

A yet additional object of the invention is to provide a dissipation portion made up of a metallic net.

A yet still additional object of the invention is to provide a dissipation portion and attachment portion made up of the same material.

Still one more object of the invention is to provide a dissipation portion and attachment portion which are made up of different materials.

Other objects of the present invention, including as well additional uses and purposes, will also become apparent to one skilled in the art from the teachings herein.

DESCRIPTION OF THE PREFERRED EMBODIMENT

The preferred embodiment of the invention is given herein by way of example with respect to use on a swimming pool cleaner. The preferred embodiment of the invention utilizes a novel cover to allow the spray of a fluid stream exiting from a movable orifice. Enhancements of the preferred embodiment which may be utilized in applications in which the additional complexity and cost is justified include allowing the stream to exit without interference when the orifice is in a first range of positions and alter the spray when the orifice is in a second range of positions.

The preferred embodiment of the invention utilizes a bag, tube, cylinder or surface, having at least two portions. The first portion is configured as an attachment portion and is directly or indirectly attached to the spray nozzle. Another portion is the dissipation portion and is intended to move with respect to the attachment portion, or otherwise with respect to the nozzle in order to contact the spray and dissipate the spray by breaking it up, without adversely affecting the propulsion imparted to the nozzle for at least some nozzle positions. The dissipation portion is preferred to be flexibly connected to the attachment portion, and to allow the spray to pass unhindered under certain conditions and to dissipate the spray under other conditions, those conditions relating to the position of the nozzle and spray as will be discussed below.

The dissipation portion is desired to be highly perforated and open, for example such as a woven net, to facilitate the dissipation action. The entire cover including both portions may be made of a single material which may be relatively solid and inflexible in low cost versions. The cover is however preferred to be flexible with a perforated open surface such as a net like or other non solid material, and having one or two open ends. Alternatively, the portions of the cover may be made of different materials or of the same material having different properties such as texture, or openness, the different materials or properties facilitating optimum performance of the portion they make up.

For simplicity, the term cover will be used in the disclosure and claims in a general sense to denote the inventive concept without any particular restriction of shape or configuration. The term cover is intended to include cylindrical, spherical, tubular, conical, bag and other shapes, with one or more openings for attachment, admission or expulsion of fluid, with the intent that the term encompass all such shapes and configurations in which the invention may be practiced as described herein.

Figure 1:
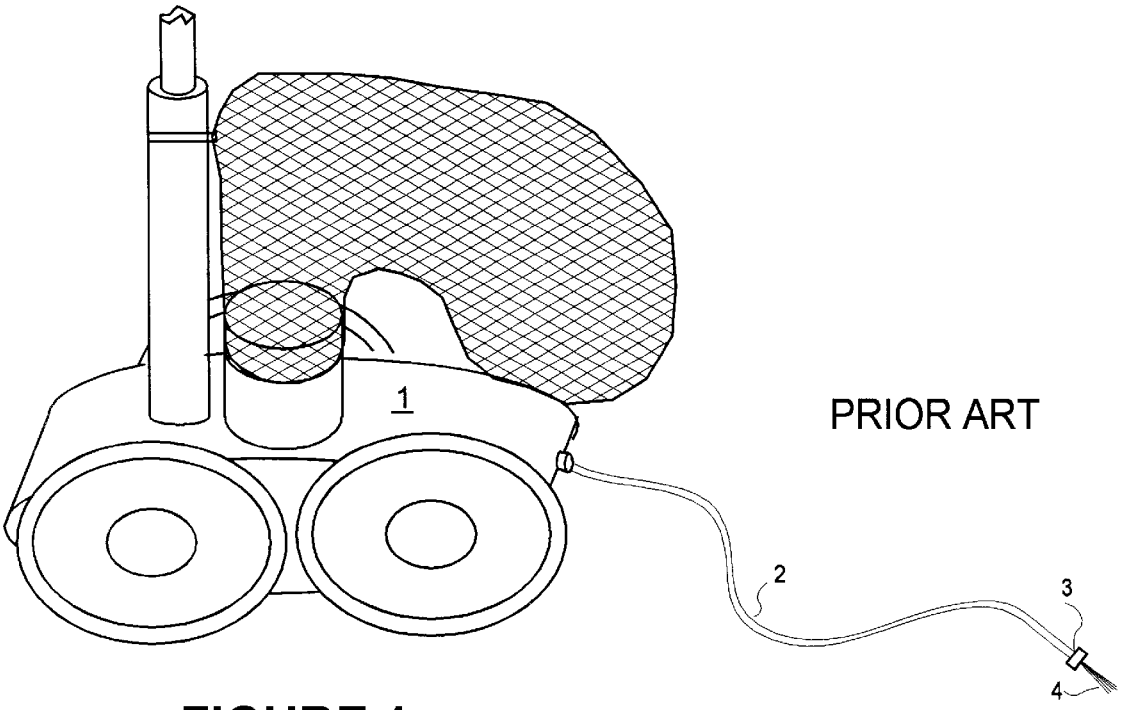
FIG. 1 is a drawing showing a prior art swimming pool cleaner in which the invention finds use.

Referring to FIG. 1, a typical swimming pool cleaner is shown with a body 1 including wheels, siphon and holding bag, a flexible hose 2 which has a nozzle 3 attached at the end, out of which a pressurized stream of water 4 is expelled. The jet propulsion caused by the stream of water 4, or spray, being expelled causes the hose 2 to whip about stirring up foreign matter such as leaves and dirt from the bottom and sides of the pool. By stirring up the foreign matter it becomes suspended in the water so that the siphon in 1 can suck the foreign matter into the holding bag. Note that both the action of the hose 2 whipping about as well as the spray of the water stream 4 is desirable.

Often, when the cleaner climbs up the sides of the pool, the hose 2 will whip out of the water spraying water jet 4 wildly about. In an attempt to prevent this occurrence it is known to decrease the pressure of 4 or to weight the nozzle 3 or hose 2, however these solutions decrease the cleaning action of the device.

Figure 2:
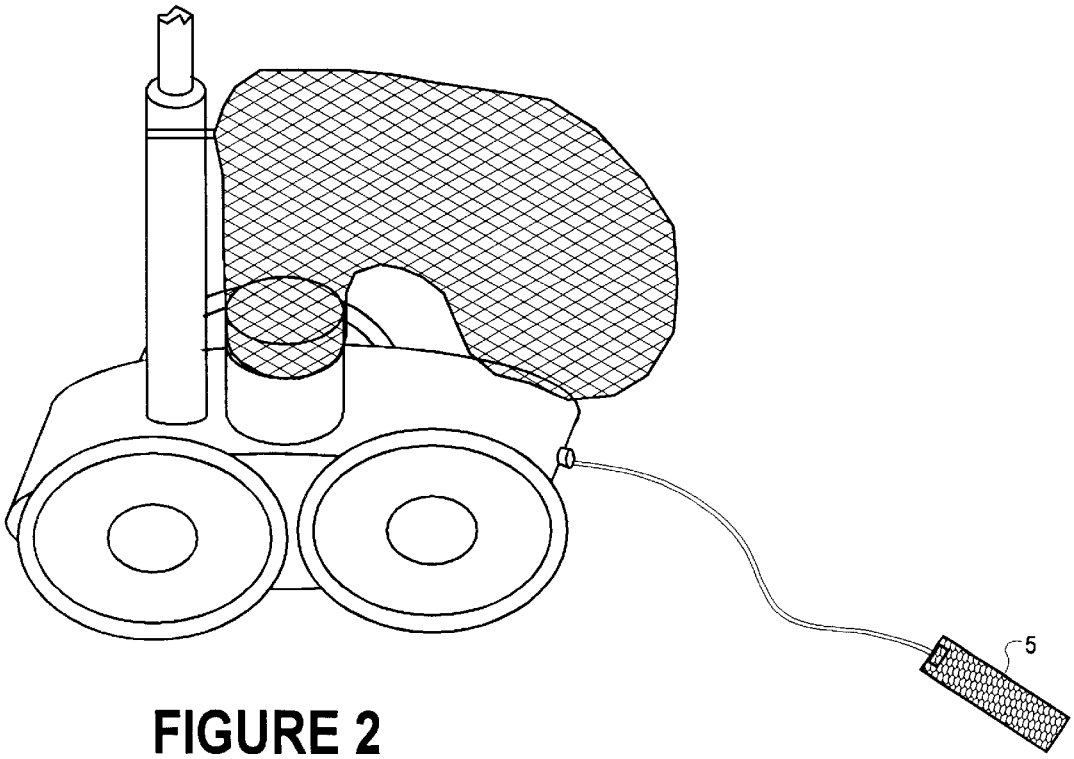
FIG. 2 is a drawing of a first embodiment of the invention.

FIG. 2 shows the same prior art cleaner as FIG. 1, with the present invention 5 attached to the nozzle 3. The cover has tow parts, an attachment portion and a dissipation portion as will be discussed below. The attachment portion is intended to attach the coven in a known position, which may be fixed or movable, with respect to the nozzle, and inherently the stream being discharged from the nozzle. The dissipation portion is intended to permit the stream to exit the cover with minimum loss of propulsion, while dissipating the stream so that it is scattered about.

The cover 5 may be a single piece, such as molded plastic, with an open or closed end. If the cover has a closed end, it may be designed to be rigidly or movably fixed to the nozzle and stream. If the cover has an open end, it is preferred that at least the dissipation portion be allowed to move in relation to the nozzle and stream. The design and in particular the characteristics of the materials to facilitate both open and closed end versions are discussed below.

The cover 5 is preferred to be in the shape of a tubular bag and made of a flexible woven metal material, with openings in each end. One end is fastened over the end of the orifice of the nozzle 3 in order to prevent its coming off. The cover is preferred to be aligned such that when it is in a known position, for example horizontal, the spray 4 passes through the tube unaffected. In normal operation of the open end cover, the pressurized spray 4 passes through the cover 5 thus the cleaning operation of the hose 2 and spray 4 continues unaffected. As the hose 2 whips about the cover deflects somewhat with respect to the spray, however the diameter of the cover is chosen such that approximately 10 degrees of movement can be accommodated without affecting the spray. Other angles may be accommodated as desired as described below.

The cover 5 is designed such that if the hose 2 and nozzle 3 depart from a known range of positions, for example roughly horizontal, the walls of the cover 5 move or flex to come into contact with the spray 4 causing the spray to be dissipated by scattering and/or diversion. In particular it is desired that the material making up the walls of the cover which the spray comes in contact with is designed such that the unified high velocity stream of fluid is converted to many lower velocity streams shooting about in many different directions. It is also desirable to have the many low velocity streams break up into droplets. A detailed description of the novel construction of various embodiments for 5 as well as for the preferred embodiment are given in more detail below.

Figure 3:
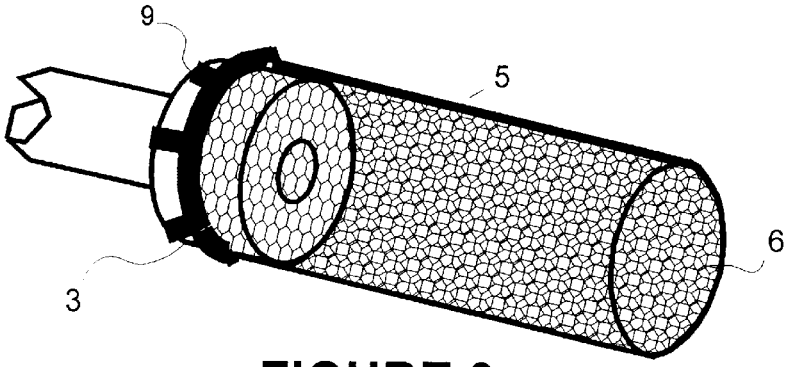
FIG. 3 is a drawing of a second embodiment of the invention.

Referring to FIG. 3, an alternate embodiment of cover 5 is shown with a closed end 6. The cover 5 is rigidly attached to the nozzle 3 by springy clips as shown, or by glue, ultrasonic welding, fasteners or other known methods. If desired the attachment clamps, clips or fasteners may be an integral part of the cover, for example when the cover is manufactured by molding plastic.

Figure 4:
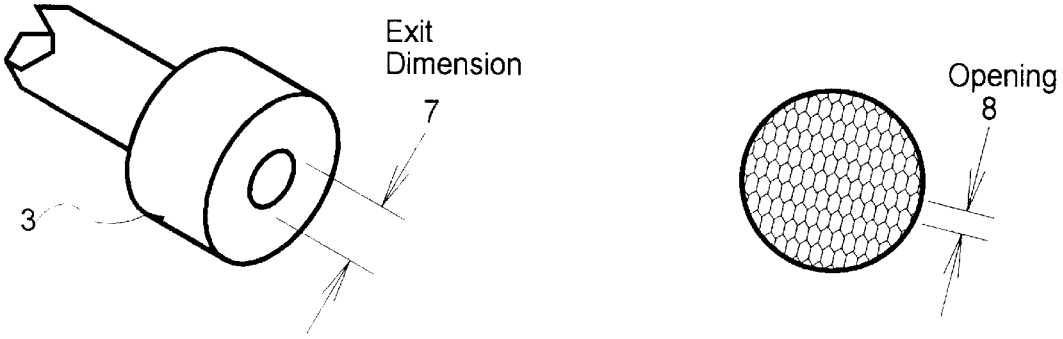
FIG. 4 is a drawing of details of the preferred embodiment of the invention.

FIG. 4 shows an examples of determining the maximum opening of the open surface used in the cover 5 as compared to the exit dimension of the fluid stream 4 at the point where it hits the dissipation portion of the nozzle. Since the fluid stream 4 diverges very little in the short distance from the orifice to the dissipation portion, that dimension usually can be considered the same as the orifice dimension 7. Note that for many nozzles the diameter of the orifice or exit opening is the same as the diameter of the fluid stream, however this is not always the case.

It has been found experimentally that the best performance is obtained from the range of openings (in the dissipation portion) whose largest dimension 8 is 0.3 to 0.95 times the largest dimension of the cross section of the fluid stream 4 which hits the portion. For construction having multiple layers of mesh or other material, all layers should be considered as if they constitute but one. For round fluid streams and holes these dimensions are the diameter, however the invention works well with any shape stream and holes, or even with multiple streams and multiple holes of varying size and/or shape. It is also been found that ratios of smallest dimension to largest dimension in the range of 1:1 (i.e. symmetrical) to 1:2 work best.

It has been discovered in testing that with ratios above 0.95 that insufficient dissipation if the spray takes place and the spray tends to shoot through the holes without being substantially broken up. At ratios below 0.2, when used with an open end in the cover 5, the spray tends to bounce off of the inner wall of the cover and spray out of the end. Therefore, ratios between 0.2 and 0.95 are recommended for open ended covers. For closed end covers, ratios from near 0 to 0.95 are suitable as long as there is sufficient surface area of the cover (resulting in sufficient total opening) to ensure that the fluid from the stream can exit the bag without excessive pressure drop as discussed above with respect to FIG. 3. For very low ratios near 0 large surfaces are needed to ensure enough open area.

It may be further noted that the roughness or texture of the cover material affects dispersion, thus it can be expected that the lower limit of 0.2 could be even lower for materials which avoid the bounce problem. Materials which have a very rough surface, such as a sponge like or carpet like surface may be used successfully, providing they are not deformed by the spray. Such surfaces are however expensive to manufacture, especially with molded plastic.

In the FIG. 3 embodiment the end of the cover is closed as shown by 6 thus the fluid stream must always pass through the openings of the cover. This configuration is the preferred embodiment for low cost since it works well, is inexpensive to manufacture, and totally eliminates the bouncing problem discussed below.

The closed end configuration, while being quite economical, is not the preferred for high performance because of the pressure drop it creates, and for the loss of cleaning from the fluid stream. It is important that the pressure drop of the fluid passing out of the cover is sufficiently low so as to prevent the pressure drop in the nozzle 3 from decreasing to the point where the propulsion fails to cause sufficient movement of the hose and nozzle thus preventing adequate cleaning action. In this respect the ratio of open area to closed area of the surface of the dissipation portion of cover 5, as well as the total surface area of cover 5 is important. It is desired that the pressure drop of the spray 4 when passing through the cover 5 be 0.1 or less times the pressure drop of the fluid passing through nozzle 3, as measured in the medium in which it operates, i.e. pool water in the present example. Other, higher rations may be utilized, for example for cost savings in cover cost, but decreased performance may be experienced. The ratio of 0.2 to 0.95 works well for closed cover embodiments, as it gives a reasonable size cover which achieves low pressure drop.

It is noted that woven and knitted cover textures are of particular usefulness, apparently due to the ability of the texture to break up the spray as compared to a smooth material in which holes have been punched. Such materials may be used in a single layer, or in multiple layers, the latter being quite useful with relatively large openings.

Figure 5:
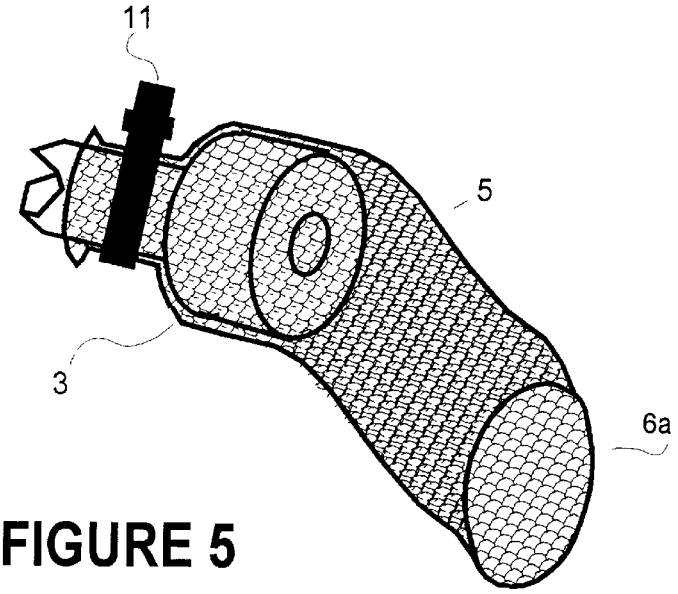
FIG. 5 is a drawing of the preferred embodiment of the invention

FIG. 5 shows the preferred embodiment of the invention utilizing a flexible knitted mesh for the cover 5, with an open end 6*a*. It is preferred that the end of the cover or tube substantially opposite the orifice is open so that when the cover is in a known position, for example substantially horizontally or otherwise supported by a surface, such as a pool bottom, the spray will pass through unaffected. In this fashion full cleaning from both the spray and the flailing about of the hose will take place.

The fluid stream sprays into the cover 5 in a fashion such that if the nozzle moves from the known position, for example by lifting from full support with the surface, the cover deflects over the stream causing it to be dissipated. This will prevent cleaning action, however it is likely that the spray is pointed away from the surface anyway so there is little overall loss of cleaning efficiency.

Several methods of fastening the cover 5 to the nozzle or hose are possible as will be known from the teachings herein. Clamping, clipping, gluing, welding, or the use of fasteners may be utilized, however it is preferred that simple molded plastic clips or cable or hose clamps which are well known in the art be used. Such fasteners are inexpensive, require no tools, are easy for even unskilled persons to use, and allow covers to be fitted to existing cleaners without modification. Molded plastic clips are quite convenient, as they may be simply snapped over the nozzle. Such clips may be molded as part of the cover, and may hold the cover rigidly or flexibly to the nozzle or hose.

Referring to FIGS. 4 and 5, the size of the cover is shown to be approximately the same diameter of the nozzle with a length about 4 times the diameter. For closed end covers it is preferred that they be large enough in relation to the mesh opening size so as to keep any pressure loss from decreasing the propulsion of the nozzle as previously discussed. For open covers, it is preferred to size the cover such that length is sufficient in relation to the flexibility or movement of the cover so that the sides of the cover flex or otherwise move to fully contact the spray when the cover is horizontal and not supported. The length is also preferred to be great enough to ensure that as the nozzle rotates upward from horizontal that the cover folds over, thus maintaining the dissipation of the spray, rather than springing back to parallel with the spray. For covers which are too short in relation to their flexibility they are likely to spring back to vertical when the spray is vertical, thus allowing the spray to pass unimpeded.

The diameter of the cover is preferred to be selected such that given the length of the cover the nozzle may be swayed from side to side ±10° without the spray contacting the edge of the cover. This size depends somewhat on the amount of normal divergence of the spray through the length of the cover, as well as the desired angle which the nozzle is to be limited to. For a typical pool cleaner application with a spray diameter of ¼", it has been found that a stainless steel cover woven of #30 wire with opening dimensions 8 of ⅛" worked well with a cover diameter of 1.5" and length of 8". For covers of this material and weave it was found that length to diameter ratios in the range of 3 to 8 gave acceptable performance where the diameter was chosen to limit nozzle deflection in the range of ±5° to ±30°.

Figure 6:
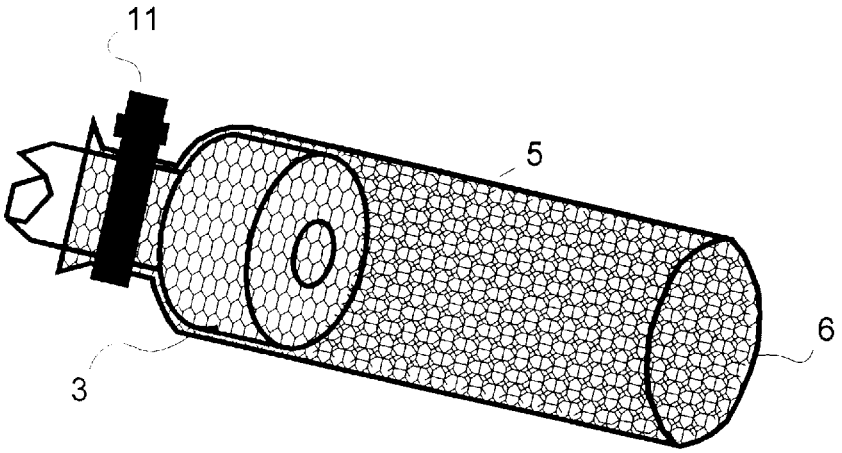
FIG. 6 is a drawing of a fourth embodiment of the invention.

FIG. 6 shows one fastening method in which the flexible, semi-rigid or rigid cover is clamped to the hose behind the larger diameter nozzle with a plastic clamp 11. This method is quite useful for adding the invention to existing cleaners having a range of nozzle sizes and shapes, since the clamp will accommodate a large range of nozzles. Note that it is desirable to leave the plastic clamp somewhat loose in order that the cover may rotate on the hose. This rotation helps to prolong the life of the cover as it is being dragged over surfaces such as pool bottoms, since the point of contact will be constantly changing due to rotation of the cover. By fastening the clamp 11 to the cover, which can be accomplished simply by threading it through the mesh openings, it can be ensured that the clamp does not slip off. If needed, a clamp (not shown) can be placed on the hose to prevent the shoulder from being pushed back over the tube.

Figure 7:
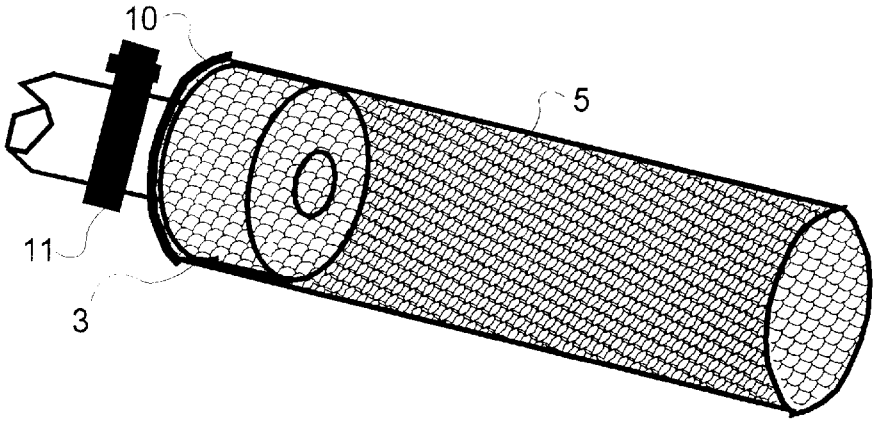
FIG. 7 is a drawing of a fifth embodiment of the invention.

FIG. 7 shows another clamping method in which a shoulder or bushing 10 is affixed to the cover 5 where the shoulder is smaller than the nozzle 3 preventing the cover from slipping off. The cover diameter is larger than the nozzle, thus allowing free rotation. If needed, a clamp 11 can be placed on the hose to prevent the shoulder from being pushed back over the tube.

The shoulder or bushing may incorporate a bearing material or bearing mechanism to reduce wear on the hose and/or nozzle due to movement and rotation of the cover. The bearing may be extended to cover more or all of the potential points of contact between the cover and hose and nozzle. If one desired, the cover could be affixed to the nozzle and the nozzle mounted to the hose with a rotatable fastening and/or bearing.

Of course, as is apparent from the teachings herein, such plastic clamps or other fastening and bearings can be located at other positions as well, such as over the nozzle 3 or elsewhere as may be desired for particular application.

Figure 8:
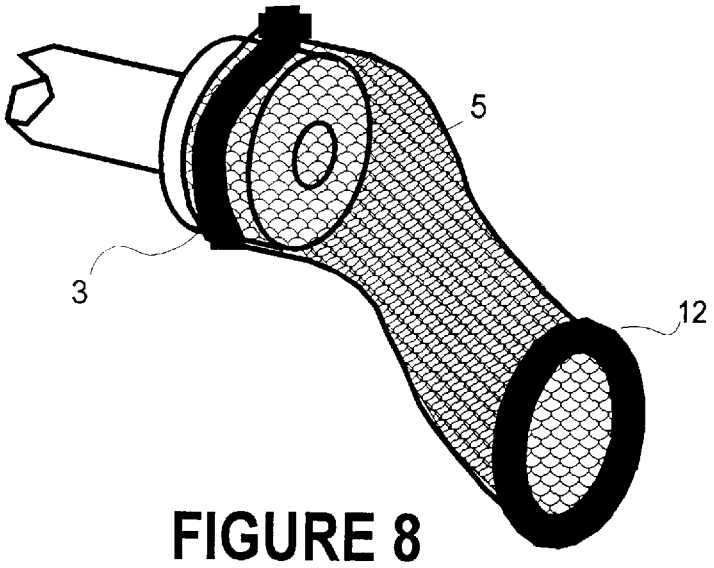
FIG. 8 is a drawing of a sixth embodiment of the invention.

FIG. 8 shows a further embodiment of the invention in which a ring 12 is attached to the end of the cover opposite the nozzle. If the weigh of the ring is substantial it will aid in the deflection of the cover when the nozzle moves away from the surface. Such weight may be combined with a more rigid cover material to provide the benefits of overall high flexibility and longer wearability. A light weight ring may be combined with a highly flexible cover material to keep the opening open. Of course the ring need not be circular and solid as shown, it may also be of different shapes for example oval, polygonal, segmented, spoked or of other design as will be apparent from the teachings herein. Of particular interest is the use of a cone or spherical shaped cover with a ring at the opening which is larger than the opening which is affixed to the nozzle. Additionally, the ring may be designed so that it is has a first buoyancy or neutral buoyancy in a first fluid such as water and sinks in a second fluid such as air.

Figure 9:
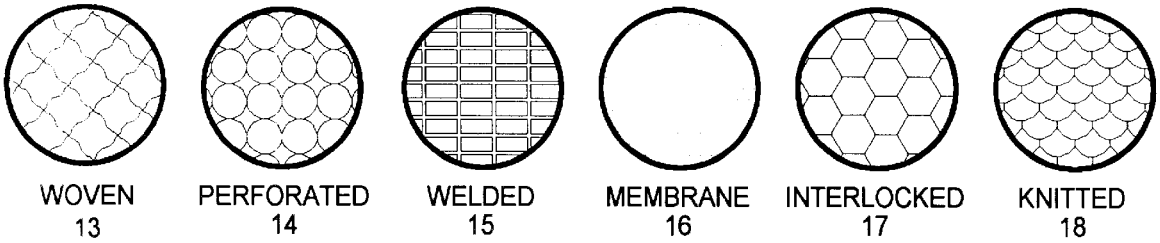
FIG. 9 is a drawing of examples of materials which may be used for the invention.

FIG. 9 shows some types of construction which may be utilized for constructing the material for the dissipation portion of the sides of the cover. The material may also be used for the entire cover. By way of example, the material may be strands, filaments or wires which are woven 13, a solid sheet which is perforated 14, strands, filaments or wires which are welded 15, a porous membrane 16, interlocked pieces such as chain mail 17 or strands, filaments or wires which are knitted 18. The material of which the cover is made may be any which is suitable for the fluid environment which it is operating in, for example plastic for corrosive environments. The texture of the cover is chosen with respect to the design of the cover such as opening size, desired dissipation of the stream, and whether or not the end of the cover is open or closed. Additionally, the cover may be only partially tubular in configuration, that is it may not encompass a full 360 degrees about the nozzle.

While the first purpose of the material chosen is to dissipate the fluid stream, secondary purposes may be attended to as well. Thus the material, fabrication, pattern, texture, etc. of the parts of the herein described invention may be chosen to achieve multiple purposes. For example, in swimming pool applications it is also desirable to provide cleaning, rubbing, scrubbing, scouring or other action on the pool sides and bottom in order to keep them clean, as well as keeping them free from mineral or other deposits, algae, bacteria and other unwanted substances. Such action may be facilitated by the use of bristles, stubble, fingers or other materials or surfaces which provide such desirable action. For example, a cover constructed of molded plastic, having molded in bristles ⅜" long with a diameter of 0.05" and populated around 50 to 100 per square inch on the outer surface. It is believed that if a suitable abrasion resistant plastic is chosen that such construction will provide good service, reasonably long life and good cleaning action.

In particular it has been found that knitted stainless steel wire mesh works quite well for swimming pool applications, and woven wire also works well. Such knitted and woven wire fabrics are commonly available in many hardware stores, being sold as lint screens for drains. This fabric is inexpensive and may be easily shaped, fitted and fastened to the nozzle as shown in FIG. 6 without any great skill being required. Note however that lint screen material is designed to pass water streams with a minimum of dissipation, rather than the need in the present invention to provide maximum dissipation. Thus care is needed to select such material which will usually result in selecting a material which was not intended (for lint screen purposes) to be used with the spray stream size and pressure of the inventive application.

Multiple layers will be useful for these wire fabrics and it has been found experimentally that a 1½" diameter by 12" tube of #30 knitted stainless steel wire works quite nicely in swimming pool applications. The tube is folded back on itself to create a two layer tube 6" long. The tube is sewn closed at one end and fastened to the spray nozzle at the other with a standard nylon wire tie. The wire tie is pulled tight enough so that the tube is securely attached to the nozzle, but loose enough that the tube can rotate freely and take on an angular displacement of a maximum of substantially 45 degrees with respect to the fluid stream. Additionally, the stainless steel knitted tube has been found to provide considerable cleaning of deposits from the pool sides and bottom due to its scrubbing action.

Despite the cleaning provided and the accompanying abrasion, the life of the tube made of stainless steel knit is quite long, one of which has provided over 800 hours of service in experimental use.

Figure 10:
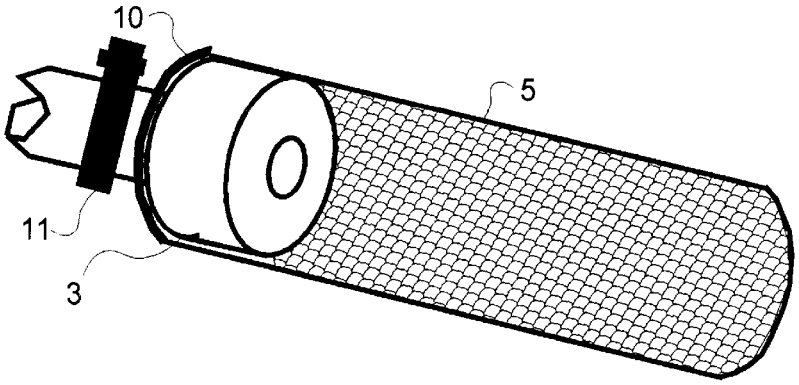
FIG. 10 is a drawing of an examples of alternate embodiments of the invention.

FIG. 10 shows an alternate embodiment of the invention where the open end of the cover opposite the nozzle is extended the full length of the cover, thus in effect forming just a woven material surface. Such a configuration is useful where the movement of the nozzle is restricted to a limited range of directions, or where the directions in which the spray is of concern are limited. In such instances it is only necessary to provide a cover wall in those areas where protection is needed, such as the partial wall shown.

It may also be noted that the cover does not need to be constructed uniformly, or symmetrically, and in fact the performance of the cover may be enhanced by the use of nonuniform construction. For example the area of the cover which is attached to the nozzle may be of solid, fingered or other material to facilitate attachment with the portion of the cover which dissipates the spray being a different material, for example those suggested with respect to FIG. 9. Nonuniformity may also be used to enhance durability with a solid or thicker portion used for nozzle attachment, a soft flexible section in the middle to enhance flexibility and a more perforated, less flexible section for contact with the spray to provide enhanced dissipation, and further including a harder section at the end to provide enhanced abrasion resistance.

The description of the preferred embodiment of the invention and prior art is given by way of example with respect to use with swimming pool cleaners. The terms which are used in the disclosure and claims are those normally used however they are intended to carry broader than normal meaning, such that they cover equivalent alternates applicable to the utilization of the invention in other applications as will be known to those of ordinary skill in the art from the teachings herein. By way of example, cover is intended to apply to all the embodiments of the invention, whether actually covering or not, and perforated in intended to apply to a group of openings no matter now formed, shaped or ordered, regular or irregular, as will be known to one of ordinary skill in the art from the teachings herein.

It will be recognized from the teachings herein that for applications where the nozzle and fluid spray are intended to occur without restriction in a first fluid, and are not desired when the nozzle travels to a second fluid, such as for example in swimming pools, the weight and buoyancy of the cover can be controlled so as to enhance the performance of the cover. For example, in a swimming pool it is desired for the nozzle to spray freely as long as it is submerged in the water, but to not spray at all when the nozzle lifts out of the water. In such applications the weight and buoyancy of the cover and/or cover and nozzle can be designed such that the cover and/or cover and nozzle are approximately zero buoyant in the water. In other words the nozzle and/or cover should neither tend to float or sink when submerged in water. When the nozzle and/or cover rise out of the water it is desired to have the cover fall toward the surface of the water, deflecting the water spray and nozzle to prevent unwanted spray of water out of the pool. This action can be accomplished by either selecting the material which the cover is made of, or weighting or adding buoyant parts (i.e. floats) to the cover and/or nozzle, to achieve zero buoyancy in water (or other fluid in which it is used). For example the cover can include a weight such as element 12 of FIG. 8 made of a suitable substance such as an air filled hollow brass ring. The total density of the ring is designed to match that of water so that it is of neutral buoyancy in water. The brass ring will then act as a weight when the cover is lifted out of the water, causing the cover to be deflected downward, thereby greatly reducing the spray from the nozzle.

The invention described herein by way of explanation of the preferred embodiment may be practiced with numerous changes in the arrangement, structure and combination of the individual elements, as well as with substitution of equivalent functions and materials for the elements in order to optimize the invention for a particular application, all without departing from the scope and spirit of the invention as described herein.

What is claimed is:

1. An apparatus for reducing unwanted spray of a fluid said apparatus including in combination:

a) a nozzle movable in response to propulsion imparted thereto by said spray;

b) an attachment portion for attaching a dissipation portion in a known relation to said nozzle and;

c) said dissipation portion having a perforated surface, wherein said dissipation portion is aligned in relation to said attachment portion such that said fluid is directed at said perforated surface at least part of the time unwanted spray is likely to occur such that said direction facilitates dissipation of said unwanted spray, with said dissipation portion further operating without adversely diminishing the propulsion imparted to said nozzle by said fluid when it is not likely to cause unwanted spraying.

2. A nozzle apparatus for reducing unwanted spray of a fluid from said nozzle, said apparatus including in combination said nozzle which moves in response to said spray of a fluid; an attachment portion for attaching a dissipation portion relative to said nozzle, wherein said nozzle moves with respect to said dissipation portion such that when said nozzle deviates from a known range of positions said fluid is directed at said dissipation portion thereby causing said spray to be dissipated.

3. An apparatus for reducing unwanted spray of a fluid from a nozzle, said apparatus including in combination:

said nozzle movable in respect to a fixed surface an attachment portion to be directly or indirectly positioned in relation to said nozzle and, a dissipation portion flexibly attached to said attachment portion, wherein said dissipation portion automatically moves with respect to said nozzle such that when said nozzle deviates from a known range of positions with respect to said fixed surface said fluid is directed at said dissipation portion thereby causing said spray to be dissipated.

4. An apparatus for reducing unwanted spray of a fluid from a nozzle, said apparatus covering at least part of said nozzle, including in combination:

a) said nozzle which is designed to move in response to said spray;

b) an attachment portion to facilitate directly or indirectly affixing a dissipation portion to said nozzle and;

c) said dissipation portion including a perforated part, wherein said dissipation portion moves with respect to said nozzle such that when said nozzle deviates by a known amount from a known position said dissipation portion is positioned relative to said nozzle such that said fluid hits said perforated middle part and is scattered.

5. An apparatus as claimed in claim 1, 2, 3 or 4 wherein said dissipation portion is made up of a perforated material.

6. An apparatus as claimed in claim 1, 2, 3 or 4 wherein said dissipation portion is made up of a woven material.

7. An apparatus as claimed in claim 1, 2, 3 or 4 wherein said dissipation portion is made up of an knitted material.

8. An apparatus as claimed in claim 1, 2, 3 or 4 wherein said dissipation portion is made up of a knitted metallic wire.

9. An apparatus as claimed in claim 1, 2, 3 or 4 wherein said dissipation portion is made up of a metallic net.

10. An apparatus as claimed in claim 1, 2, 3 or 4 wherein said dissipation portion is made up of molded plastic like material.

11. An apparatus as claimed in claim 1, 2, 3, or 4 wherein said spray may occur submerged in a body of water or at least partially out of said water with said dissipation portion operative to provide more diversion of said spray when occurring at least partially out of said water as compared to when said spray occurs submerged.

12. An apparatus as claimed in claim 1, 2, 3, or 4 wherein said spray may occur in a first fluid or a second fluid or both, said spray occurs without substantial restriction in said first fluid, said dissipation portion operable to alter said spray when occurring at least partially in said second fluid.

13. A cover for reducing unwanted spray of a fluid stream from a nozzle, said cover including in combination:

a) said nozzle being designed to move in response to propulsion imparted thereto by said stream;

b) an attachment portion having plastic clips which snap over said nozzle to hold said cover into place and;

c) a dissipation portion having a surface covered with openings, which surface is aligned such that said stream is directed thereat at least whenever unwanted spray is likely to occur due to movement of said nozzle, said openings having a largest dimension in the range of 0.2 to 0.95 times the largest dimension of the cross section of said fluid stream.

14. A method of reducing unwanted spray of a fluid stream from a nozzle, said method including:

a) permitting said nozzle to move in response to said spray;

b) attaching a tubular member to said nozzle, which member is full of holes;

c) permitting the movement of said tubular member along with said nozzle over a first range of motion of said nozzle so as to not interfere with said spray;

d) restricting the movement of said tubular member relative to said nozzle when said movement exceeds said first range of motion and enters a second range of motion of said nozzle so as to interfere with said spray, wherein said second range is greater than said first range.

15. A method of reducing unwanted spraying of fluids from a hose nozzle having an open end out of which said fluid is propelled in a stream said method including the steps of:

a) movably attaching a hole filled cover over said open end of said nozzle;

b) allowing said cover to attain a position wherein when unwanted spray is unlikely to take place said stream passes through said cover unaltered; and c) when said nozzle attains a position where unwanted spray is likely to take place, allowing said cover to deflect over said liquid stream causing said stream to be scattered rather than sprayed in said stream beyond said cover.

* * * * *